United States Patent [19]

Uranishi et al.

[11] Patent Number: 4,809,667

[45] Date of Patent: Mar. 7, 1989

[54] APPARATUS FOR CONTROLLING AMOUNT OF FUEL-VAPOR PURGED FROM CANISTER TO INTAKE AIR SYSTEM

[75] Inventors: Kouji Uranishi, Susono; Takaaki Itou, Mishima, both of Japan

[73] Assignee: Toyota Jidosha Kabushiki Kaisha, Aichi, Japan

[21] Appl. No.: 114,642

[22] Filed: Oct. 28, 1987

[30] Foreign Application Priority Data

| | | | |
|---|---|---|---|
| Oct. 29, 1986 | [JP] | Japan | 61-255745 |
| Oct. 29, 1986 | [JP] | Japan | 61-255746 |
| Oct. 30, 1986 | [JP] | Japan | 61-256748 |

[51] Int. Cl.[4] ..... F02M 39/00

[52] U.S. Cl. ..... 123/520; 123/518

[58] Field of Search ..... 123/520, 521, 518, 516

[56] References Cited

U.S. PATENT DOCUMENTS

| | | | |
|---|---|---|---|
| 4,275,697 | 6/1981 | Stoltman | 123/520 |
| 4,308,842 | 1/1982 | Watanabe | 123/520 |
| 4,318,383 | 3/1982 | Iritani | 123/520 |
| 4,377,142 | 3/1983 | Otsuka | 123/520 |
| 4,467,969 | 8/1984 | Matsumura | 123/520 |
| 4,495,904 | 1/1985 | Sakaino | 123/520 |

*Primary Examiner*—Carl Stuart Miller

*Attorney, Agent, or Firm*—Kenyon & Kenyon

[57] ABSTRACT

In a fuel-vapor emission control system of an internal combustion engine having a purge control valve, a first start of the engine is detected after a fuel supply to the fuel tank and the time from when the engine is started is measured. Then, the amount of fuel-vapor purged from a canister filled with an adsorbent for capturing fuel-vapor is decreased for a predetermined time period. As a result, when the engine is started for the first time after the fuel supply, the amount of fuel-vapor purged is decreased to thereby improve the emission characteristic and the driveability of the vehicle.

8 Claims, 8 Drawing Sheets

APPARATUS FOR CONTROLLING AMOUNT OF FUEL-VAPOR PURGED FROM CANISTER TO INTAKE AIR SYSTEM

BACKGROUND OF THE INVENTION (1) Field of the Invention

The present invention relates to an apparatus for controlling an amount of fuel-vapor purged from an adsorbent filled canister in a fuel-vapor emission-control system.

(2) Description of the Related Art

Generally, modern automobiles are equipped with an evaporative emission-control systems having a canister filled with an adsorbent such as activated charcoal, for capturing fuel-vapor from a fuel tank and preventing an escape thereof into the open air. Fuel-vapor is caused by evaporation, and a large part of the atmosphere in the fuel tank is composed of fuel-vapor. In the fuel-vapor emission-control system, fuel-vapor from the fuel tank flows to the charcoal canister, the charcoal particles pick up and hold the fuel-vapor, and, when the engine runs, air flows through the charcoal canister on the way to the intake air system, e.g., intake air pipe. This air picks up the fuel-vapor trapped in the canister and carries it to the intake air pipe, where it is mixed with the air-fuel mixture and fed to the engine and thus burned, instead of being allowed to enter the atmosphere as fuel-vapor.

In this fuel-vapor emission-control system, large quantities of fuel-vapor occur not only during a supply of fuel to the fuel tank but also just after this fuel supply is stopped. Accordingly, large quantities of vapor-laden air from the fuel tank are carried through the emission-control line and into the canister, where the fuel-vapor is adsorbed by the charcoal. In this context adsorbed is used to denote that the fuel-vapor is trapped by the charcoal particles. Therefore, the canister captures much fuel-vapor during and just after the fuel supply to the tank.

Note, when the engine is started for the first time after a fuel supply, fresh air is drawn in by the intake-manifold vacuum, is sent through the canister, and removes, or purges, a large amount of the fuel-vapor from the canister, even though an amount of air flow is the same as usual. If the adsorbent in the canister is an activated charcoal, the purge rate from the canister after the fuel supply to the fuel tank is stopped is high at first and then gradually decreases as shown in FIG. 1

As a result, when the vehicle is first run after a fuel supply, a large quantity of fuel-vapor is supplied into the intake air system, and it is likely that the amount of fuel-vapor supplied will exceed the control range of the air-fuel ratio controller. In this case, the air-fuel ratio becomes overrich and both the emission characteristic and the driveability of the vehicle will be worsened.

SUMMARY OF THE INVENTION

It is an object of the present invention to provide an apparatus for controlling an amount of fuel-vapor purged from a canister filled with an adsorbent into an intake air system, when the engine is first started after a supply of fuel to the fuel tank, in order to improve both the emission characteristic and the driveability when the vehicle is first run after the fuel supply.

It is an another object of the present invention to provide an apparatus for controlling an amount of fuel-vapor purged from the canister into an intake air system, which can improve both the emission characteristic and the driveability when the vehicle is first run after the fuel supply, wherein the provision of a switch for detecting the fuel supply to the fuel tank is made unnecessary.

According to the present invention, a first start of the engine after a fuel supply to the fuel tank is detected by the fuel supply detecting signal and the engine start detecting signal, and the time from when the engine is started is measured, and the amount of fuel-vapor purged from a canister filled with an adsorbent for capturing the fuel-vapor is then decreased for a predetermined time period. As a result, when the engine is started for the first time after the fuel supply, the amount of fuel-vapor purged from the canister is decreased, thus improving the emission characteristic and the driveability of the vehicle.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 2:
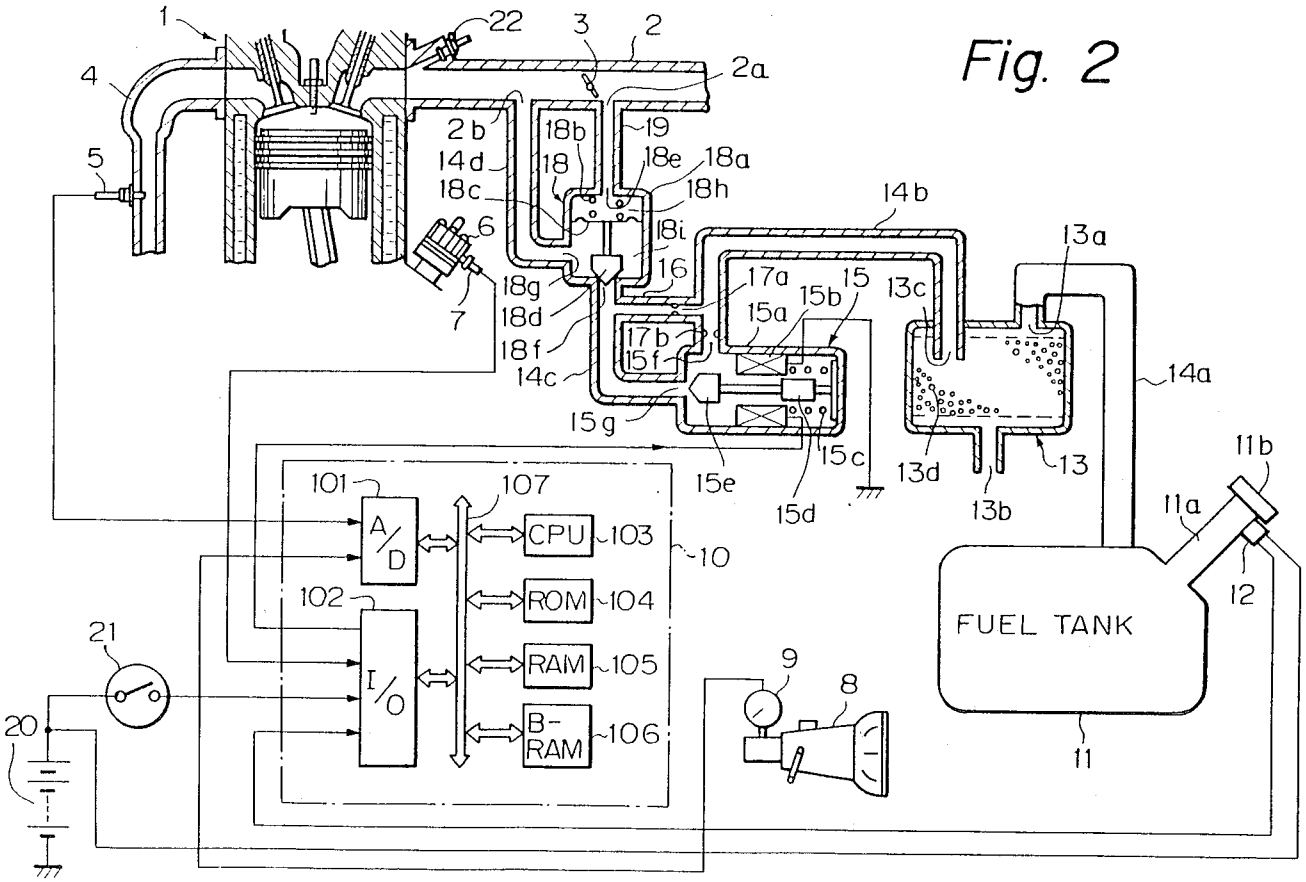
FIG. 2 is a schematic diagram of an internal combustion engine according to the present invention; and, FIGS. 3 to 8 are flowcharts showing the operation of the control circuit of FIG. 1.

In FIG. 2 which illustrates an internal combustion engine according to the present invention, reference numeral 1 designates a four-cycle spark ignition engine disposed in an automotive vehicle, and a throttle valve 3 is provided in an air-take passage 2 for adjusting the amount of air taken into the engine 1.

A crank angle sensor 7 is disposed in a distributer 6 for detecting the angle of the crank-shaft (not shown) of the engine 1. In this case, the crank-angle sensor 7 generates a pulse signal at every 30° CA. The pulse signals from the crank sensors 7 are supplied to an input/output (I/O) interface 102 of the control circuit 10.

In addition, a fuel injection valve 22 in the air-intake passage 2 is provided for supplying pressurized fuel from the fuel system to the air-intake port of the cylinder of the engine 1. Note, other fuel injection valves are also provided for other cylinders, but these are not shown in FIG. 2.

An $O_2$ sensor 5 is provided in an exhaust gas passage 4 of the engine 1 for detecting a concentration of oxygen in the exhaust gas. The $O_2$ sensor 5 generates and transmits an output voltage signal to the A/D converter 101 of the control circuit 10.

Attached to a transmission 8 of the engine 1 is a speed sensor 9 for detecting the speed of a vehicle on which the engine is mounted. The speed sensor 9 generates and transmits an output voltage signal to the A/D converter 101 of the control circuit 10.

A fuel tank 11 has a filler pipe 11*a*, and the opening of the filler pipe 11*a* is closed by a cap 11*b*. Mounted on the filler pipe 11*a* near the cap 11*b* is a cap switch 12 for detecting whether or not the cap 11*b* is opened to enable a fuel supply. One terminal of the cap switch 12 is connected directly to the battery 20 and the other terminal is connected to the I/O interface 102 of the control circuit 10. When the opening of the filler pipe 11*a* is closed by the cap, the cap switch 12 is OFF, but when the filler cap 11*a* is removed the cap switch 12 is made ON, to send a signal to the control circuit 10 and thus initiate a purge control program.

The fuel-vapor emission-control system is provided with a canister 13 filled with activated charcoal 13*d*. The charcoal canister 13 has three openings 13*a*, 13*b*, and 13*c*. The opening 13*a* is connected to an upper part of the fuel tank 11 by a vapor vent pipe 14*a*; the opening 13*b* is open to the atmosphere; and the opening 13*c* is connected to a purge control valve (VSV) 15, which is a normally open type magnetic valve, by a purge pipe 14*b*, and is connected to a vacuum control valve (VCV) 18 via pipes 14*b*, 16, and 14*c*. When fuel-vapor occurs in the fuel tank, fuel-vapor passes through the pipe 14*a* and into the canister 13 where it is adsorbed by the activated charcoal 13*d*.

The VSV 15 consists of a casing 15*a*, a coil 15*b*, a spring 15*c*, a plunger assembly 15*d*, and a valve 15*e* attached to the free end of the plunger assembly. The casing 15*a* has two openings 15*f* and 15*g*. The opening 15*f* is connected to the canister 13 by the pipe 14*b*, and the opening 15*g* is connected to the VCV 18 by the pipe 14*c*. An orifice 17*b* is provided inside the pipe 14*b* near the opening 15*f*, and the pipes 14*b* and 14*c* are connected by a bypass pipe 16 having an orifice 17*a* therein. Preferably, the bore of the orifice 17*a* is smaller than the bore of the orifice 17*b*. Note, in this embodiment, the bore of the orifice 17*b* is twice as large as that of the orifice 17*b*.

When the coil 15*b* is not energized, the valve 15*e* is made to open the opening 15*g* by the force of the spring 15*c*. Conversely, when the coil 15*b* is energized, the valve 15*e* is moved toward the opening 15*g* by the magnet force of the coil 15*b*, against the force of the spring 15*c*, to close the opening 15*g*. Normally, when the opening 15*g* is open, vapor-laden air from the canister 13 can pass through two orifices 17*a* and 17*b* to the VCV 18, but when the opening 15*g* is closed, vapor-laden air from the canister 13 can pass only through the narrower orifice 17*a* to the VCV 18. Accordingly, the amount of fuel-vapor purged from the canister is decreased when the opening 15*g* is closed.

The VCV 18 consists of a casing 18*a*, a spring 18*b*, a diaphragm 18*c*, and a valve 18*d* connected to the diaphragm 18*c*. The casing 18*a* has three openings 18*e*, 18*f*, and 18*g*. The opening 18*e* is connected to a port 2*a* of the air-intake passage 2 which is located upstream of the throttle valve 3 by a pipe 19. The opening 18*g* is connected to a port 2*b* of the air-intake passage 2 and is located downstream of the throttle valve 3, by a pipe 14*d*. The opening 18*f* is connected to the pipe 14*c*. The casing 18 is divided into a spring chamber 18*h* and a valve chamber 18*i* by the diaphragm 18*c*. The spring 18*b* pushes the diaphragm 18*c* in the direction which allows the spring chamber 18*h* to expand, and thus the opening 18*f* is normally closed by the valve 18*d*.

When the engine is started and running idle, the throttle valve 3 is closed, and the spring chamber 18*h* is connected to the atmosphere through the air-intake passage 2, so that the opening 18*f* is closed by the valve 18*d*. Thus, fuel-vapor purged from the canister 13 is stopped at the VCV 18 when the engine is running idle.

When the engine is brought to an acceleration state, the throttle valve 3 is opened by rotating in the counterclockwise direction in FIG. 2, and the port 2*a* is then connected to the area downstream of the throttle valve 3. Until the throttle valve 3 is fully opened, a vacuum is generated downstream of the throttle valve 3. This vacuum causes the diaphragm 18*c* to move in the direction in which the spring chamber 18*h* is contracted, thereby opening the opening 18*f*. Thus, fuel-vapor purged from the canister 13 is supplied through the VCV 18 to the air-intake passage 2 and then burned in the engine when the engine is in the acceleration state. Conversely, when the engine is further accelerated, the throttle valve 3 is further opened to allow intake of a large amount of air to the engine, and the pressure downstream of the throttle valve 3 becomes equal to the pressure upstream of the throttle valve 3, in accordance with the degree of opening of the throttle valve 3. That is the pressure in the chamber 18*h* approaches atomospheric pressure, and the diaphragm 18*c* is pushed by the spring 18*b*, and thus the valve 18*d* closes the opening 18*f*. In this state, fuel-vapor purged from the canister 13 is stopped at the VCV 18.

The control circuit 10, which may be constituted by a microcomputer, further comprises a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a bus 107 interconnecting the elements 101 ~ 106, and the like.

The battery 20 is connected directly to the backup RAM 106 and, therefore, the content of the RAM 106 is not erased even when a key switch 21 is turned OFF. The key switch 21 is connected to an input/output (I/O) interface 102 of the control circuit 10.

Interruptions occur at the CPU 103 when the A/D converter 101 completes an A/D conversion and generates an interrupt signal; when the crank angle sensor 7 generates a pulse signal; and when the clock generator (not shown) generates a special clock signal.

Figure 1:
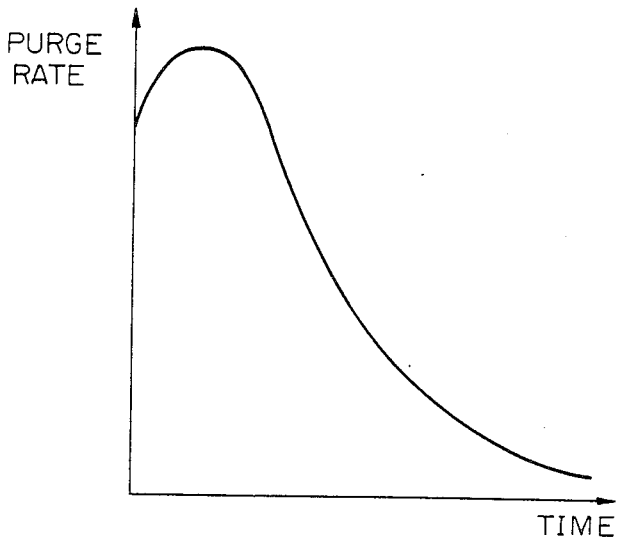
FIG. 1 is a graph showing the characteristics of a purge rate from the charcoal canister over a period of time.

The operation of the control circuit 10 of FIG. 1 will be explained with reference to the flow charts of FIGS. 3, 4, 5, 6, 7 and 8.

Figure 3:
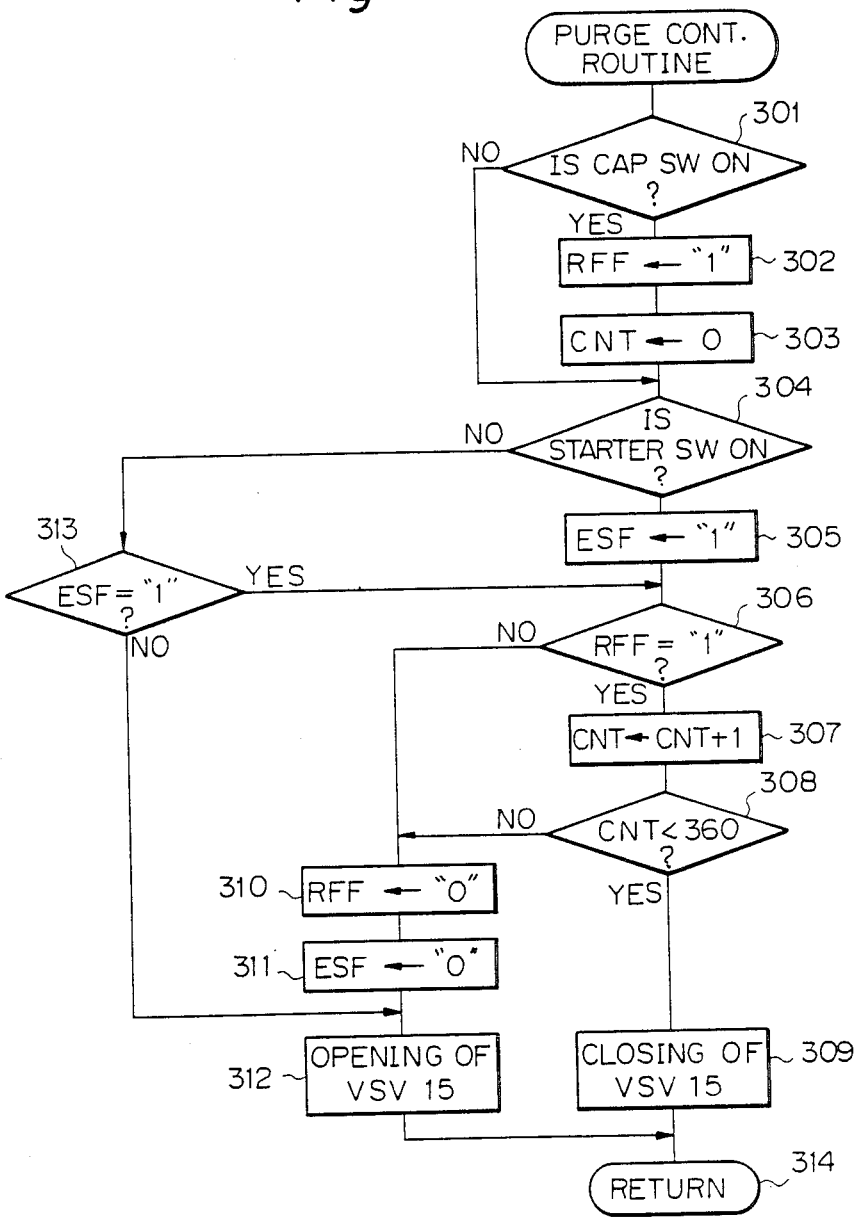

FIG. 3 is a routine for controlling the amount of fuel-vapor purged from the charcoal canister 13 to the intake air passage 2, and is executed at every predetermined time period such as 500 ms after the key switch 21 is turned ON, or when the cap switch 12 is turned OFF. In this routine, the amount of fuel-vapor supplied to the intake air passage 2 is controlled by opening or closing the VSV 15. That is, when the VSV 15 is OPEN, the amount of fuel-vapor sent to the intake air passage 2 is increased and when the VSV 15 is CLOSED, the amount of fuel-vapor sent to the intake air passage is decreased.

At step 301, it is determined whether or not the cap switch 12 is turned ON. If the cap switch 12 is turned ON, the control proceeds to steps 302 and 303. If the cap switch 12 is turned OFF, the control proceeds to step 304. At step 302, a fuel-feed flag REF is set to "1", and at step 303, a time counter CNT is reset. The control proceeds then to step 304. Note, the flag REF is stored in the backup RAM 106 to hold the data.

At step 304, it is determined whether or not a starter switch (not shown in FIG. 2) is turned ON. If the starter switch is turned ON, the control proceeds to step 305, at which an engine start flag ESF is set to "1" and the control then proceeds to step 306. If the starter switch is not turned ON, the control proceeds to step 313. Note, the flag ESF is also stored in the backup RAM 106 to hold the data.

At step 306, it is determined whether or not the flag REF equals "1". If the flag REF="1", the control proceeds to step 307, where the counter CNT is incremented by 1 and then proceeds to step 308. If the flag REF≠"1", the control proceeds to step 310.

Then at step 308, it is determined whether or not the counter CNT is larger than a predetermined value of 360. Note, this means that the counter CNT must count 3 minutes because this routine is run every 500 ms. If CNT <360 (YES), the control proceeds to step 308, and a current is not fed to the coil 15*d* of the VSV 15 and the VSV 15 is closed. If CNT≧360 (NO), the control proceeds to step 310.

At step 310, the flag REF is set to "0", and then at step 311, the flag ESF is also set to "0". The control then proceeds to step 312, at which a current is fed to the coil 15*d* of the VSV 15 to open the VSV 15.

At step 313, it is determined whether or not the flag EFS equals "1". If ESF="1" (YES), the control proceeds to step 306, but if ESF≠"1", the control proceeds to step 312. This routine is completed at step 314.

In this above mentioned fuel-vapor emission control system, this routine is run when the cap switch 12 is turned ON by removal of the filler cap 11*b* to supply fuel to the fuel tank 11. At this time, when the cap switch 12 is ON but the engine 1 is stopped, the control proceeds to steps 301, 302, 303, 304, 313, 312 and 314, in this order. When the engine 1 is started by the starter switch for the first time after the fuel supply, the control proceeds to steps 301, 304, 305, 306, 307, 308, 309, and 314, in this order, until the starter switch is turned OFF. When the starter switch is turned OFF, the control proceeds to steps 301, 304, 313, 306, 307, 308, 309, and 314 repeatedly until the counter CNT has counted to 360. Thus the amount of fuel-vapor purged from the canister 13 is decreased by closing of the VSV 15. Then, when the counter CNT has counted to 360, the control once proceeds to steps 301, 304, 313, 306, 307, 308, 310, 311, 312, and 314, in this order, and in the following routine, the control proceeds to steps 301, 304, 313, 306, 310, 311, 312, and 314, in this order, repeatedly. Thus the amount of fuel-vapor purged from the canister 13 is increased by the opening of the VSV 15. Note, according to the present invention, the VSV 15 is closed for the predetermined time period only when the engine is first started after a supply of fuel.

Another operation of the control circuit 10 will be explained with reference to FIGS. 4, 5, 6, 7 and 8.

Figure 4:
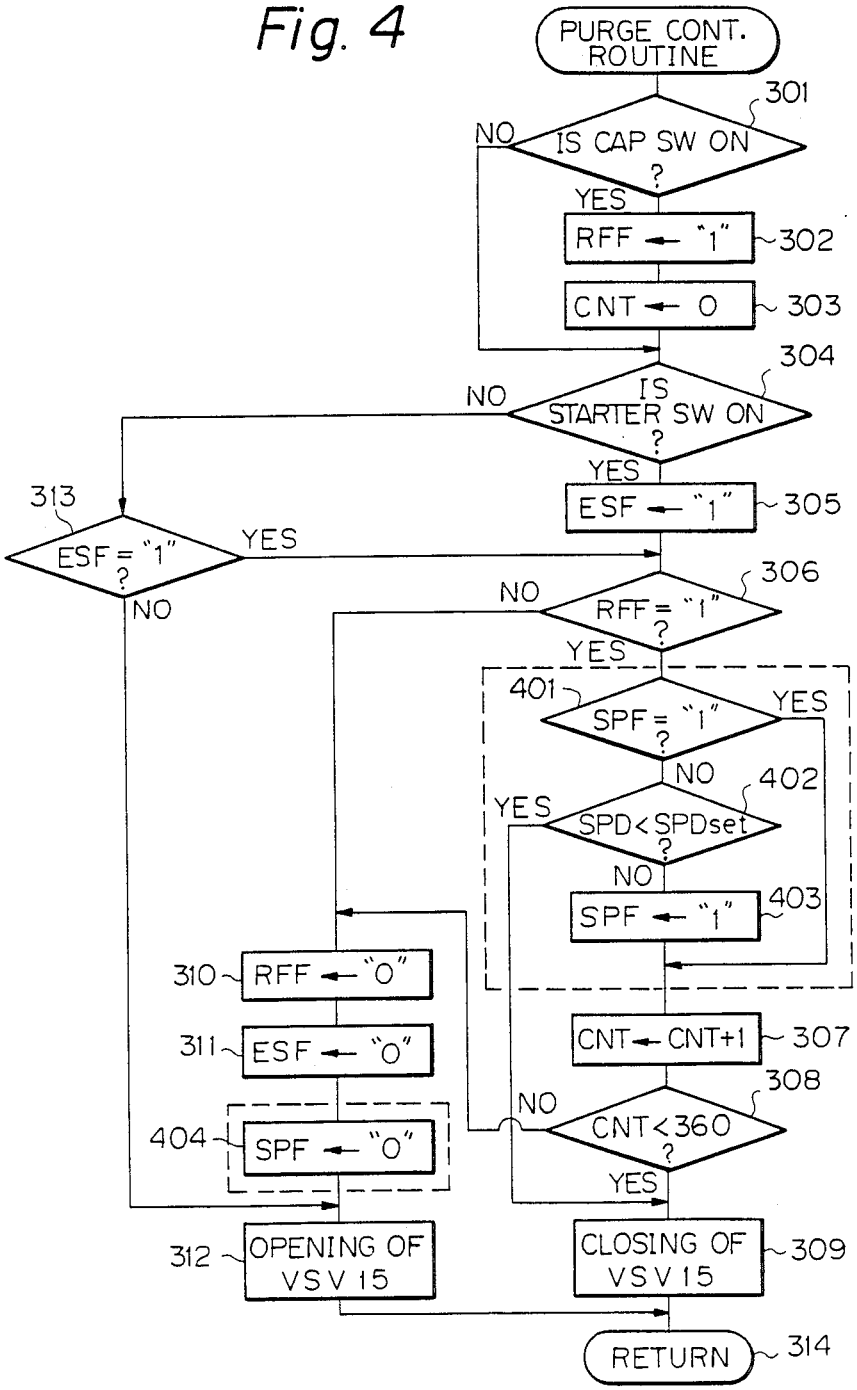

FIG. 4 is a modification of the flowchart shown in FIG. 3. In FIG. 4, steps 401, 402, 403, and 404 are added to steps 301 to 314. In detail, step 401 to 403 are added between steps 306 and 307, and step 404 is added between steps 311 and 312. At step 401, it is determined whether or not a speed flag SPF equals "1". If SPF="1" (YES), the control proceeds to step 307 at which the counter CNT is incremented by 1. IF SPF≠"1" (NO), the control proceeds to step 402. At step 402, it is determined whether or not the vehicle speed SPD is less than a predetermined speed SPDset. If SPD< SPDset (YES), the control proceeds to step 309, at which the VSV 15 is closed. If SPD ≧SPDset (NO), the control proceeds to step 403 which sets the flag SPF to "1", and the control then proceeds to step 307. At step 44, the flag SPF is set to "0".

In the above mentioned operation, the vehicle speed SPD is detected by the speed sensor, and the counter CNT counts up when the speed SPD once becomes larger than a predetermined speed SPD set, such as 15 km per hour. Therefore, according to the control shown in FIG. 4, the counter will not count until the speed SPD exceeds the speed SPDset, and thus the VSV 15 is closed for a longer period than by the control as shown in FIG. 3.

Figure 5:
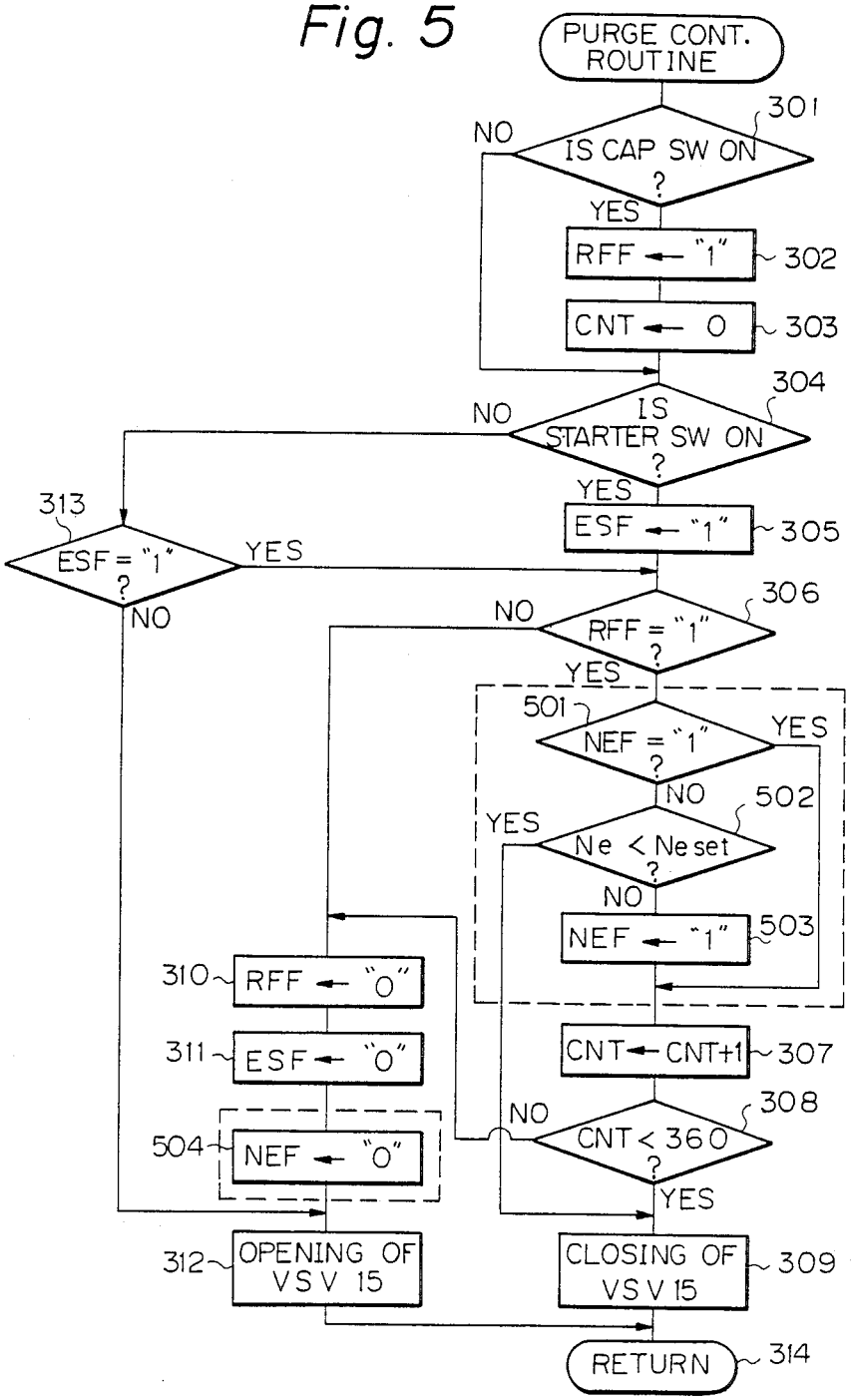

FIG. 5 is a modification of the flowchart shown in FIG. 3. In FIG. 5, steps 501, 502, 503, and 504 are added to steps 301 to 314. In detail, step 501 to 503 are added between steps 306 and 307, and step 504 is added between steps 311 and 312. At step 501, it is determined whether or not an engine rotation flag NEF equals "1". If NEF="1" (YES), the control proceeds to step 307, at which the counter CNT is incremented by 1. If NEF≠"1" (NO), the control proceeds to step 502. At step 502, it is determined whether or not the engine rotation speed Ne is less than a predetermined engine rotation speed Neset. If Ne<Neset (YES), the control proceeds to step 309 at which the VSV 15 is closed. If Ne ° Neset (NO), the control proceeds to step 503, at which the flag NEF is set to "1". The control then proceeds to step 307, and at step 504, the flag NEF is set to "0".

In the above mentioned operation, the engine rotation speed HE is detected by the crank angle sensor, and the counter CNT counts up when the speed Ne once becomes larger than a predetermined speed Neset, such as 1,200 rpm. Therefore, according to this control as shown in FIG. 5, the counter will not count until the engine rotation speed Ne exceeds the speed Neset, and thus the VSV 15 is closed for a longer period than by the control as shown in FIG. 3.

Figure 6:
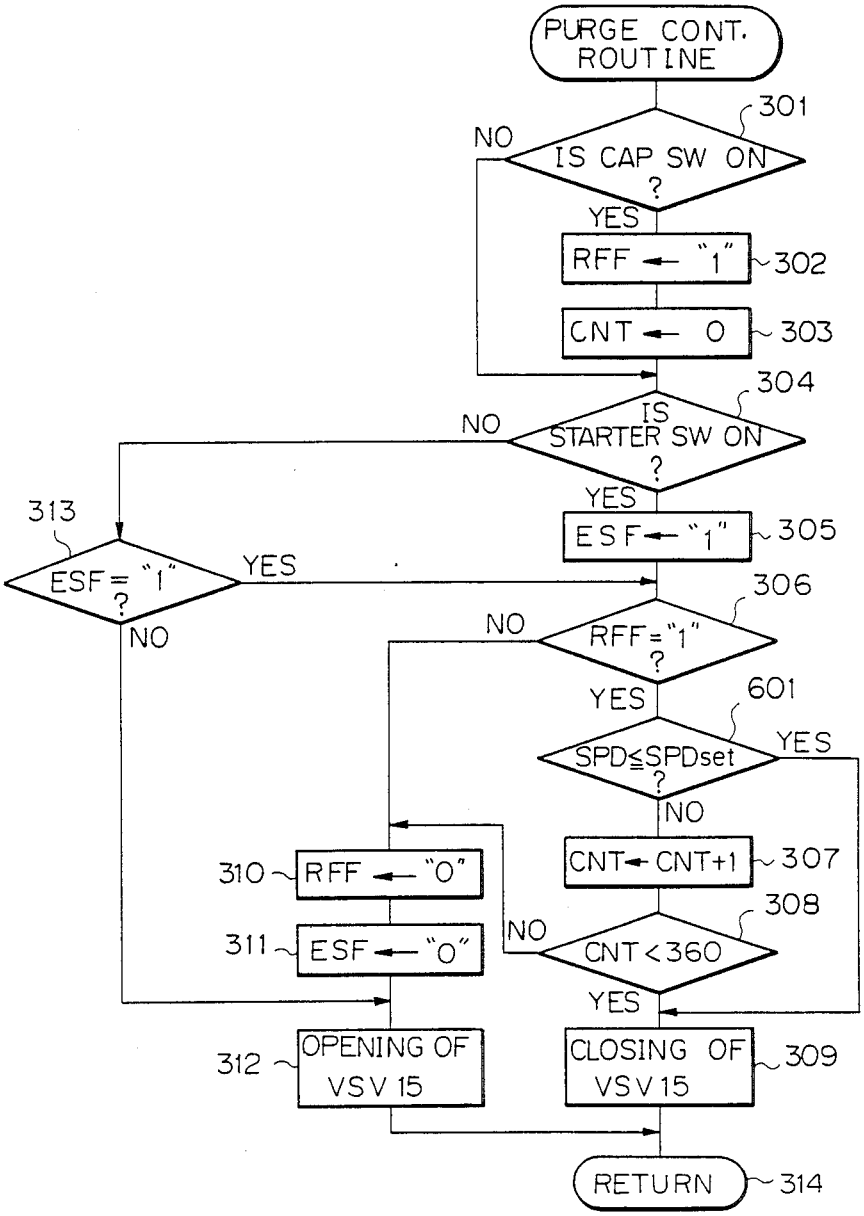

FIG. 6 is a modification of the flowchart shown in FIG. 3. In FIG. 6, only step 601 is added between steps 306 and 307. At step 601, it is determined whether or not the vehicle speed SPD is less than a predetermined speed SPDset. If SPD <SPEset (YES), the control proceeds to step 309, at which the VSV 15 is closed. If SPD<SPDset (NO), the control proceeds to step 307, at which the counter CNT is incremented by 1.

In the above mentioned operation, the vehicle speed SPD is detected by the speed sensor, and the counter CNT counts up only when the speed SPD is larger than a predetermined speed SPDset, such as 15 km per hour. That is, the counter CNT in this modification counts the time for which the vehicle speed SPD exceeds the predetermined speed SPDset. Therefore, according to this control as shown in FIG. 6, the longer the time during which the vehicle runs slower than SPDset, the longer the VSV 15 remains closed.

Figure 7:
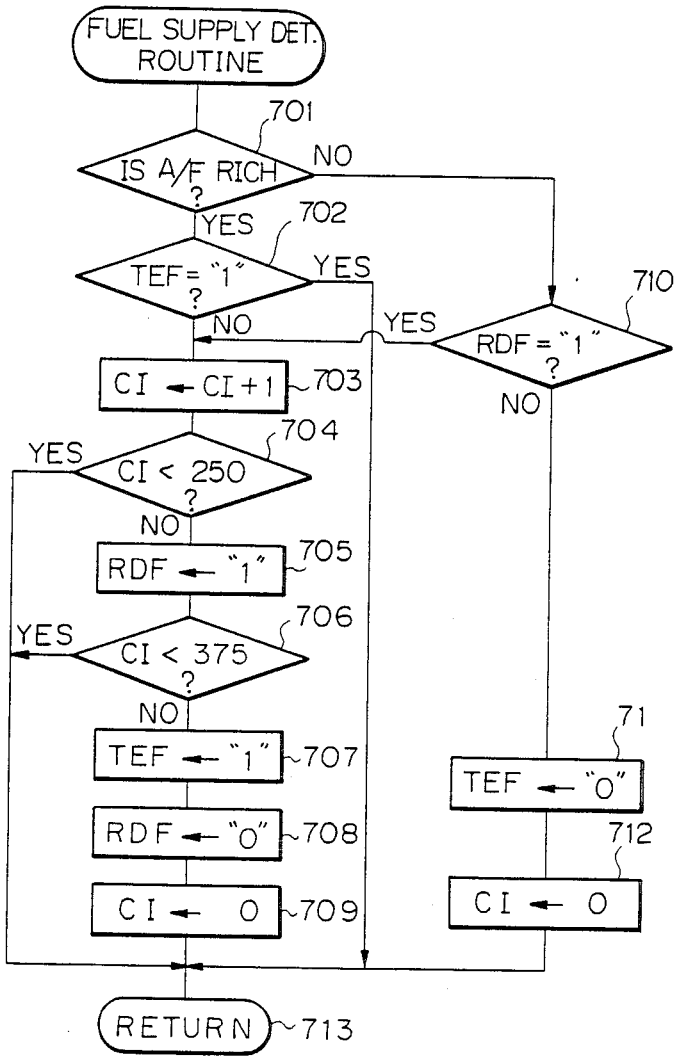
Figure 8:
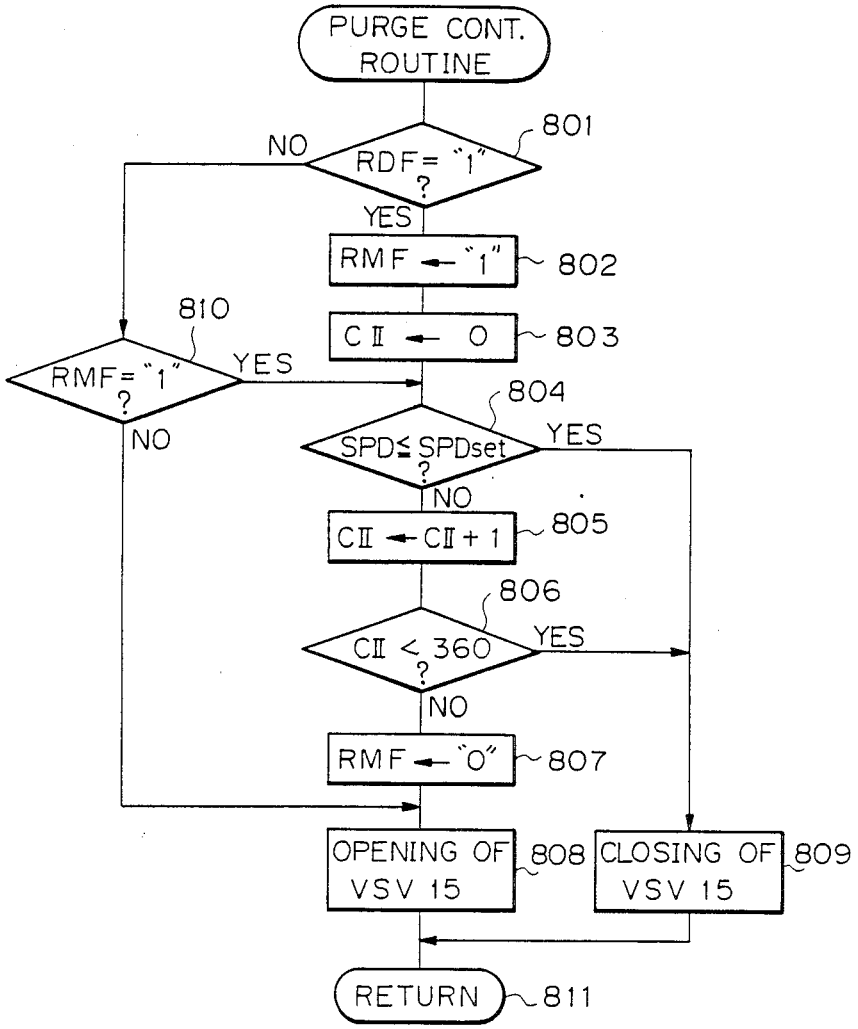

FIGS. 7 and 8 show another operation of the control circuit 10. In this operation, the fuel supply to the fuel tank is detected by detecting a continuation of a rich state of the exaust gas.

FIG. 7 is a routine for detecting a fuel supply to the fuel tank 11, executed at every predetermined time period such as 4 ms. In this routine, the engine 1 is running, and the $O_2$ sensor 5 is determining whether or not an air-to-fuel ratio (A/F) is rich.

At step 701, it is determined whether or not the A/F is rich. If the A/F is rich (YES), the control proceeds to step 702, but if the A/F is not rich, the control proceeds to step 710.

At step 702, it is determined whether or not a time expiration flag TEF equals "1". If TEF="1", the control proceeds to step 713, but if TEF≠"1", the control proceeds to step 703, at which a counter CI is incremented by 1. The control then proceeds to step 704.

At step 704, it is determined whether or not the counter CI has counted to 250, that is, it is determined whether or not the rich state has continued for 1 second, as this routine is executed every 4 ms. If CI<250 (YES), the control proceeds to step 713, but if CI≧250 (NO), the control proceeds to step 705, at which a fuel feed detecting flag RDF is set to "1". The control then proceeds to step 706.

At step 706, it is determined whether or not the counter CI has counted to 375, that is, it is determined whether or not the rich state has continued for 1.5 seconds. If CI<375 (YES), the control proceeds to step 713 and this routine is completed, but if CI≧375 (NO), the control proceeds to steps 707, 708, 709, and 713, in this order. At step 707, the flag TEF is set to "1", at step 708, the flag RDF is set to "0", and at step 709, the counter CI is reset.

At step 710, it is determined whether or not the flag RDF is equal to "1". If RDF="1", the control proceeds to step 703, but if REF≠"1", the control proceeds to steps 711, 712, and 713 in this order. At step 711, the flag TEF is set to "0", and at step 712, the counter is reset. This routine is completed at step 713.

In this routine, when the A/F ratio is changed from lean to rich, the control first proceeds to steps 701, 702, 703, 704, and 713, in this order, until the counter has counted to 250 since the flag TEF="0", Then, when the counter has counted to more than 250, the control proceeds to step 701, 702, 703, 704, 705, 706, and 713, in this order, until the counter has counted to 375. In this operation, the flag REF is set to "1". If the counter count is more than 375, the control once proceeds to steps 701, 702, 703, 704, 705, 706, 707, 708, 709, and 713, in this order. In this operation, the flag TEF is set to "1", but the flag RDF is set to "0"and the counter CI is reset. Since the flag TEF is set to "1"at step 707, the control next proceeds to step 701, 702 and 713. In this way, when a rich state of the exhaust gas is detected for more than 1 second, the flag RDF is set to "1", and when the rich state of the exhaust gas is detected for more 1.5 seconds, the flag REF is set to "0"and the flag TEF is set to "1". In other words, the flag REF is set to "1"only after 500 ms.

FIG. 8 is a routine for controlling the amount of fuel-vapor purged from the canister, and is executed at every predetermined time period such as 500 ms.

At step 801, it is determined whether or not the flag RDF equals "1". If RDF="1"(YES), the control proceeds to step 802, but if RDF≠"1"(NO), the control proceeds to step 810. AT step 802, a fuel supply memory flag RMF is set to "1", and at step 803, another counter CII is reset. The control then proceeds to step 804.

At step 804, it is determined whether or not the vehicle speed SPD is less than a predetermined speed SPDset. If SPD < SPDset (YES), the control proceeds to step 809 at which the VSV 15 is closed. If SPD≧SPDset (NO), the control proceeds to step 805, at which the counter CII is incremented by 1. Then at step 306, it is determined whether or not the count at the counter CII is smaller than a predetermined value of 360. Note, this means that the counter CII counts 3 minutes because this routine runs every 500 ms. If CII<360 (YES), the control proceeds to step 809 and a current is not fed to the coil 15*d* of the VSV 15, and thus the VSV 15 remains shut. If CNT≧360 (NO), the control proceeds to step 807, at which the flag RMF is set to "0", and then proceeds to step 808, at which a current is fed to the coil 15*d* of the VSV 15 to open the VSV 15.

At step 810, it is determined whether or not the flag RMF equals "1". If the flag RMF="1", the control proceeds to step 804, but if the flag RMF≠"1", the control proceeds to step 808. After step 808 or 809, the control proceeds to step 811 to complete this routine.

In this above mentioned routine, the flag RDF ="1"when a fuel supply is detected by the routine shown in FIG. 7. Therefore, when a fuel supply is not detected, the control proceeds to steps 801, 810, 808, and 811, in this order, and the VSV 15 is open. Conversely, when a fuel supply is detected and the speed SPD is lower than the predetermined speed SPDset, the control once proceeds to 801, 802, 803, 804, 809, and 811, in this order. In this operation, the flag RMF is set to "1"and the VSV 15 is closed. Since the flag RMF is set to "1", the control proceeds to steps 801, 810, 804, 809, and 811 from this routine if the speed SPD is not changed. When the speed SPD becomes larger than SPDset in the above mentioned state, the control proceeds to steps 801, 810, 804, 805, 806, 809, and 811, in this order until the counter CII has counted to 360. Thus, the amount of fuel-vapor purged from the canister 13 is decreased by closing the VSV 15 after a delay from the detection of a fuel supply. Then, when the counter CII has counted to 360, the control once proceeds to steps 801, 810, 804, 805, 806, 807, 808, and 811, in this order. Since the flag RMF is set to "0"at step 807 in this routine, the control proceeds to steps 801, 810, 808, and 811, in this order, repeatedly thereafter.

We claim:

1. An apparatus for controlling an amount of fuel-vapor purged from a canister filled with a fuel-vapor adsorbent and sent to an intake air pipe of an internal combustion engine having a fuel tank connected to said canister, comprising:

means for detecting a supply of fuel to said fuel tank;

means for detecting a start of said engine;

means, positioned between said canister and said intake air pipe, for adjusting the amount of fuel-vapor purged from said canister;

means for decreasing the amount of fuel-vapor purged for a predetermined time period by controlling said adjusting means when a first start of said engine is detected after a fuel supply to said fuel tank is detected.

2. An apparatus as set forth in claim 1, further comprising:

means for detecting whether or not a driving condition parameter of said engine has reached a predetermined value;

means for decreasing the amount of fuel-vapor purged by controlling said adjusting means until said driving condition parameter reaches a predetermined value when the first start of said engine is detected after the fuel supply is detected;

means for decreasing the amount of fuel-vapor purged by controlling said adjusting means for another predetermined time period after said parameter reaches said value.

3. An apparatus as set forth in claim 2, wherein said driving condition parameter is a speed of the vehicle on which said engine is mounted.

4. An apparatus as set forth in claim 2, wherein said driving condition parameter is a rotational speed of said engine.

5. An apparatus as set forth in claim 2 or 3, further comprising:

means for counting a duration for which said speed exceeds a predetermined value;

means for decreasing the amount of fuel-vapor purged by controlling said adjusting means until said duration reaches a predetermined value when the first start of said engine is detected after the fuel supply is detected.

6. An apparatus as set forth in claim 1, wherein said adsorbent is an activated charcoal.

7. An apparatus for controlling an amount of fuel-vapor purged from a canister filled with a fuel-vapor adsorbent and sent to an intake air pipe of an internal combustion engine in a vehicle having a fuel tank connected to said canister, the apparatus comprising:

means, installed at an exhaust gas pipe, for detecting a rich state of said engine;

first timing means for counting the elapsed time of each period during which the detecting means detects a rich state of said engine;

means for detecting if the speed of the vehicle exceeds a predetermined value;

means, positioned between said canister and said intake air pipe, for adjusting the amount of purged fuel-vapor sent from said canister to said intake air pipe;

second timing means responsive to the speed detecting means for counting the elapsed time of each period during which said speed exceeds the predetermined value; and means responsive to the first and second timing means for controlling said adjusting means to decrease the amount of purged fuel sent to the intake pipe whenever the elapsed time counted by the first timing means exceeds a first predetermined value until said elapsed time counted by the second timing means reaches a second predetermined value.

8. An apparatus as set forth in claim 7, wherein said adsorbent is activated charcoal.

* * * * *

UNITED STATES PATENT AND TRADEMARK OFFICE

CERTIFICATE OF CORRECTION

PATENT NO. : 4,809,667

DATED : 7 March 1989

INVENTOR(S) : Uranishi et al.

It is certified that error appears in the above-identified patent and that said Letters Patent is hereby corrected as shown below:

| Column | Line | |
|---|---|---|
| 4 | 15 | after "is" insert --,--. |
| 5 | 4 | change "by $_1$"to --by 1--. |
| 6 | 19 | change "Ne * Neset" to --Ne $\geq$ Neset--. |
| 6 | 39 | change "SPD < SPDset" to --SPD $\geq$ SPDset-- |

Signed and Sealed this

Ninth Day of January, 1990

*Attest:*

JEFFREY M. SAMUELS

*Attesting Officer*

*Acting Commissioner of Patents and Trademarks*